United States Patent [19]

Ebeling et al.

[11] Patent Number: 4,732,226

[45] Date of Patent: Mar. 22, 1988

[54] DRILLING MACHINE

[75] Inventors: Wolfgang Ebeling, Hanover; Helmut Kolditz, Wolfenbüttel, both of Fed. Rep. of Germany

[73] Assignee: Turmag Turbo-Maschinen AG and Gesellschaft Fuer Strahlen- und Umweltforschung Muenchen MBH, Sprockhoevel, Fed. Rep. of Germany

[21] Appl. No.: 26,525

[22] Filed: Mar. 16, 1987

[30] Foreign Application Priority Data

Mar. 19, 1986 [DE] Fed. Rep. of Germany ..... 3609111

[51] Int. Cl.[4] ..... E21B 4/18; E21C 1/00; E21D 1/06

[52] U.S. Cl. ..... 175/94; 175/96; 175/99; 175/102; 175/104; 299/56; 299/60; 299/81

[58] Field of Search ..... 175/99, 94, 95, 96, 175/92, 102; 299/56, 58, 81, 59, 60, 67, 31

[56] References Cited

U.S. PATENT DOCUMENTS

| | | | |
|---|---|---|---|
| 3,376,942 | 4/1968 | Van Winkle | 175/99 X |
| 3,379,264 | 4/1968 | Cox | 175/99 X |
| 4,274,675 | 6/1981 | Paurat et al. | 175/102 X |
| 4,646,853 | 3/1987 | Sugden et al. | 175/99 X |

FOREIGN PATENT DOCUMENTS 801615 9/1958 United Kingdom .

OTHER PUBLICATIONS

"Gestängloses Schachtbohren aus dem vollen Querschnitt", by Karl H. Brümmer, from *Sonderdruck aus "unser Betrieb" der Deilmann-Haniel GmbH* (Nr. 29/1981).

"Herstellen von Schächten mit gestänglosen Schachtbohrmaschinen", by Karl H. Brümmer, from *Glucklauf* 121 (Nr. 11/1985).

*Primary Examiner*—Stephen J. Novosad

*Attorney, Agent, or Firm*—Michael J. Striker

[57] ABSTRACT

A shaft drilling machine comprises a drill head carrying drill tools thereon, a device for guiding the drill head in a shaft, a device for advancing the drill head in the shaft, and drive aggregates which are lowered into the shaft together with the drill head and driving the latter. A sluice for providing a rinsing fluid is arranged in a pilot drill. A rinsing conduit and an ascending conduit for extracting from the shaft a drilled material-rinsing fluid mixture generated during the drilling operation are connected to the sluice which is formed as a bucket wheel.

22 Claims, 3 Drawing Figures

DRILLING MACHINE

BACKGROUND OF THE INVENTION

The present invention relates to a drilling machine for drilling bores in mine shafts.

Drilling machines of the type under discussion include a guide device, an advancing device, a drilling head which together with drive aggregates is lowered into the mine shaft, a sluice and a rinsing device by means of which a fluid via a rinsing conduit is conveyed to the drill head, then mixed there with a material being drilled, and a generated drilled material-fluid mixture is conveyed through an ascending conduit to the shaft mouth.

A mine shaft drilling machine of the foregoing type has been disclosed in DEILMANN-HANIEL GmbH, No. 29, 1981, page 13, FIG. 6. This conventional drilling machine includes, in addition to a preliminary stage from the drilling head to an end diffusor and a fine grain hydrocyclone and from there through an overgrain separating station to an automatically controlled double container feeder, at least one main conveying means which starts at the double container feeder, also on the sluice.

Structural modifications are possible, for example with a spiral chamber feeder for the main conveyor stage, also in case of one sluice, a two-stage hydraulic drilled material admission and conveying of this material.

The disadvantage of both aforementioned structures resides in that such structures require a very complex equipment to operate in order to transmit the material being drilled to the main conveying stage. Thus the mine shaft drilling machine as a whole is controlled and creates noise sources which affect the operation of such a drilling machine. At page 14 of the abovementioned technical publication it has been set forth that for future mine shaft drilling machines a pneumatic main stage conveyor is driven with a special bucket wheel-blower machine. Such unknown shaft drilling machine must have a preliminary conveying stage which should be effected by means of a suction drilling process with a vacuum pickup system for rinsing. Even with the drive out of at least 600 kw for the vacuum blowers, such a conveying device would require considerable expenses and space consumption. Such a mine shaft drilling machine has not been known uptill now.

Numerous drill rod-less shaft drilling machines require preliminary conveying stages before the drilled material has reached the main conveying device in the mine shaft, which is formed, for example of a series circuit of the channel gear pumps wherein the first pump is provided. Such a drilling machine has been disclosed, for example in "Gluckauf 121", 1985, No. 11, page 842.

All these conventional shaft drilling machines have in common the principle of conveying the drilled material from the borehole base to the platform or frame of the drilling machine arranged above the drill head, and the combination of a plurality of containers for the transition from the preliminary conveying stage to the main conveying stage.

SUMMARY OF THE INVENTION

It is an object of the present invention to provide an improved drilling machine of the foregoing type.

It is another object of the invention to provide a shaft drilling machine by which the drilled material-fluid mixture would be conveyed directly in a single conveying stage from the shaft base up to its mouth without the utilization of the conventional preliminary conveyor stage.

These and other objects of the invention are attained by a shaft drilling machine comprising a drill head carrying drill tools thereon; means for guiding said drill head in a shaft; means for advancing said drill head in the shaft; drive means which are lowered into the shaft together with said drill head and driving the latter; a sluice and rinsing means for providing a rinsing gluid; a rinsing conduit connected to said rinsing means to lead said fluid to said drill head in the vicinity of which said fluid is mixed with a drilled material; an ascending conduit to convey a generated drilled material-fluid mixture to a shaft mouth; a pilot drill connected to said drill head; said sluice being formed as a bucket wheel sluice positioned in said pilot drill, said bucket wheel sluice being connected to said rinsing conduit and said ascending conduit. Thereby the drilled material-fluid mixture is hydraulically or pneumatically transported via the ascending conduit from the sluice to the shaft mouth. For this transportation in case of hydraulic transporting means only one pump above the shaft mouth is required, and in case of pneumatic transporting means, only one compressor on the rinsing conduit, which is a descending conduit in the proposed invention, is required. The fluid pushed through the rinsing conduit to the sluice is continually fed towards the drilled material. Such a drilling machine does not require a preliminary transporting stage, and thus high costs due to extensive wear of additional structural components of such a preliminary stage are avoided.

A further advantage of this invention resides in that the entire drive system for the transporting means (pump or compressor) can be arranged at the mouth of the shaft and not in the shaft itself.

The bucket wheel sluice may be positioned centrally of said pilot drill and have a bucket wheel, said drive means including a first hollow shaft for driving said bucket wheel, and a second hollow shaft concentrically surrounding said first hollow shaft; said pilot drill further including a bucket wheel housing driven by said second hollow shaft with a number of revolutions different from that of said bucket wheel.

The first hollow shaft may be rotated in a direction opposite to that of said second hollow shaft.

The second hollow shaft has an axis of elongation; said rinsing means may include at least one rinsing passage extending parallel to said axis of elongation, and a rinsing head, said rinsing passage having a lower end which opens into said bucket wheel sluice and an upper end which is connected through said rinsing head with said rinsing conduit.

The first hollow shaft may have a central ascending passage which has a lower end connected to a discharge opening of said bucket wheel sluice and an upper end, said drill head having a sealing head, said upper end of said ascending passage being connected to said ascending conduit via said sealing head.

The ascending conduit and the rinsing conduit may be non-rotationally supported. Thus the first and second hollow shafts are rotatable.

This rotation is attained because the guide means include a frame, said drive means further include a first drive motor for driving said first hollow shaft, and a second drive motor for driving said second hollow shaft, said first and second motors being positioned on said frame.

The drive means may further include a transmission means interconnected between respective motors and said first and second hollow shafts, respectively.

The transmission means may be a gear transmission means or, alternatively, a chain transmission.

Advantageously the bucket wheel housing may include a head portion, a peripheral portion which forms a jacket of said pilot drill, and a bottom part, said head portion and said bottom part being rotation-fixed to said pilot drill, said bucket wheel being rotatable between said head portion and said bottom part.

The pilot drill may have front-side drill tools and a spiral provided on an outer periphery of said pilot drill.

The bucket wheel may be closed at a periphery thereof, said head portion of said housing having an inlet opening, said bucket wheel being loadable with drilled material through said inlet opening and being emptied through said discharge opening provided in said head portion.

The drill tools on said drill head may be positioned at least at a level of said inlet opening of said head portion, said drill tools being at least active and inactive enlarging drill tools, said spiral starting approximately at said level of said inlet opening. Thereby the drilled material is transported by means of the spiral from the borehole base at the pilot drill up to the inlet opening in the pilot drill and thus to the inlet opening of the bucket wheel sluice whereas, at the same time, drillings generated at this height by the tools carried by the drill head are forced by sprinkling fluid in the direction from the sloped shaft base to the aforementioned inlet opening in the pilot drill.

The drive means may further include a bucket wheel shaft connected to first hollow shaft for driving said bucket wheel, said bucket wheel shaft having a longitudinal bore and a plurality of radial bores positioned above and below said bucket wheel, respectively and branched off said longitudinal bore, said head portion having an annular channel which opens into said rinsing passage for fluid, said radial bores positioned above said bucket wheel being connected to said annular channel.

The bottom part may have an enlarged channel connected to said discharge opening, said radial bores positioned below said bucket wheel opening into said enlarged channel.

In order to ensure a sealing of the bottom part relative to the bucket wheel, on the one hand, and to facilitate counteracting to the fluid pressure in the region of overlapping of the bucket wheel, at least one energy storage means may be provided, said bottom part being axially displaceable on said bucket wheel shaft against a force of said energy storage means and being pressable against said bucket wheel.

The energy storage means may include a spring positioned at said bottom part, said spring having one end supported against said bottom part and another end supported against an inner wall of said pilot drill.

In order to adjust a counterpressure relative to the rotating bucket wheel in the outlet region of the bucket wheel wherein a rinsing fluid pressure occurs, which leads to a great overpressure, it is advantageous that the bottom part is provided in the region of the greatest pressure loading thereof with at least one cylinder-piston unit with a piston having one piston end which is loaded with the drilled material-fluid mixture and a cylinder formed by a recess provided in said bottom part whereas another end of said piston is supported against said inner wall of said pilot drill.

Furthermore, in a direction of rotation of said bucket wheel, between said outlet opening and said inlet opening, in at least said head portion and said bottom part of said bucket wheel housing, unloading regions may be provided, which are connected with an unloading passage which ends in a free space of the shaft.

The first and second hollow shafts may be spaced to form a hollow space therebetween which constitutes a further rinsing passage.

The main rinsing passage may be connected at least with an intermediate space formed between a peripheral wall of said bucket wheel and a periphery of said pilot drill, and with longitudinal bores in said periphery extending parallel to an axis of rotation of said pilot drill, said at least intermediate space and longitudinal bores being connected to said enlarged channel in said bottom part.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
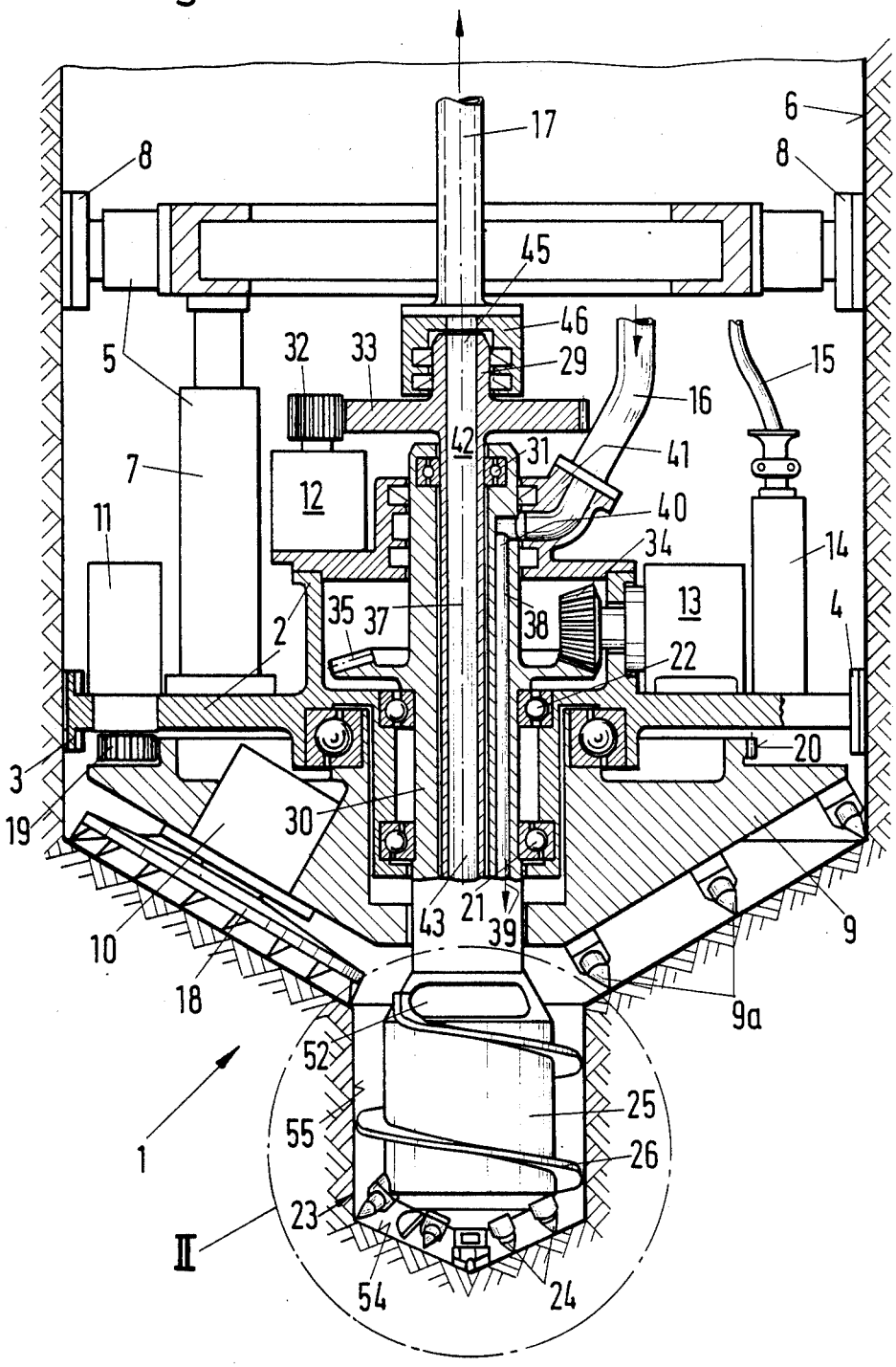
FIG. 1 is an axial sectional view of a mine shaft drilling machine according to the invention.

As shown in FIG. 1, the mine shaft drilling machine according to the invention substantially comprises a guiding device 2 which is provided with guiding pressure pads 3, 4 which lie against the wall of the mine shaft 6, an advancing device 5 with at least one advancing cylinder 7 and clamping shoes 8, a plurality of descending drive aggregates 10, 11, 12, 13 with a drilling head 9, an energy distributor 14 with an electrical feeding conduit 15, and a rinsing device which feeds a rinsing fluid via a non-illustrated pump or compressor arranged near the mine shaft mouth through a rinsing conduit 16 and then pushes the drilled material-fluid-mixture via an ascending conduit 17 towards the mine shaft mouth.

The drive aggregate 10 includes a motor which directly rotates a cutting disk 18 and thus forms together with this disk an active drilling tool. The drive aggregate 11 is also a motor which, via a drive gear 19, an external toothing 20 of the drilling head 9, which acts as a tool carrier or tool support, brings active and/or non-active drilling tools **9*a* secured to the drilling head 9** to rotation.

Inside the drilling head 9, is positioned a pilot drill 23 which is supported in the drilling head 9 by bearings 21, 22 and is provided with front-side drilling tools 24 and a spiral 26 formed on the peripheral face of pilot drill 23.

Figure 2:
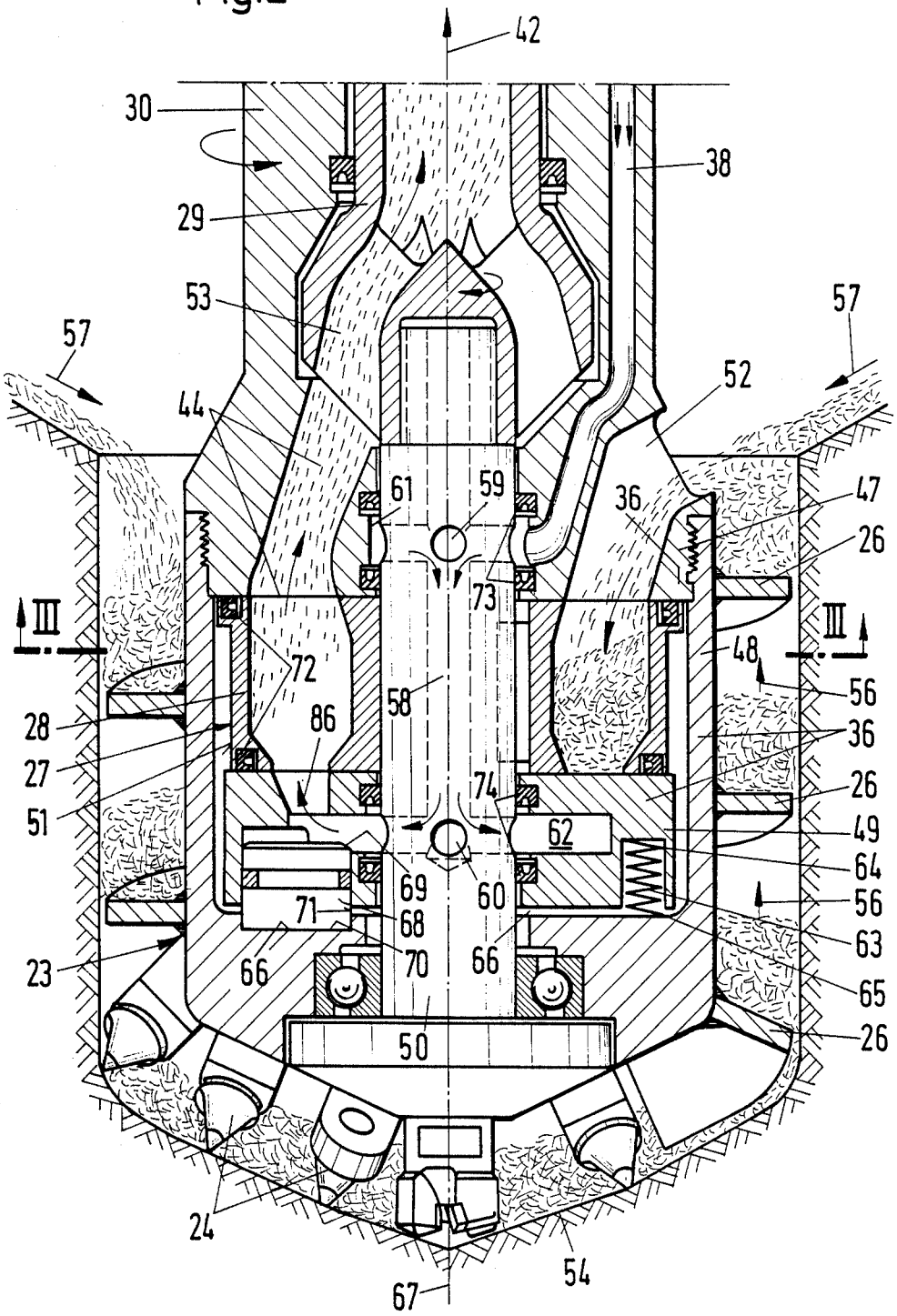
FIG. 2 is an enlarged view of detail II of FIG. 1.
Figure 3:
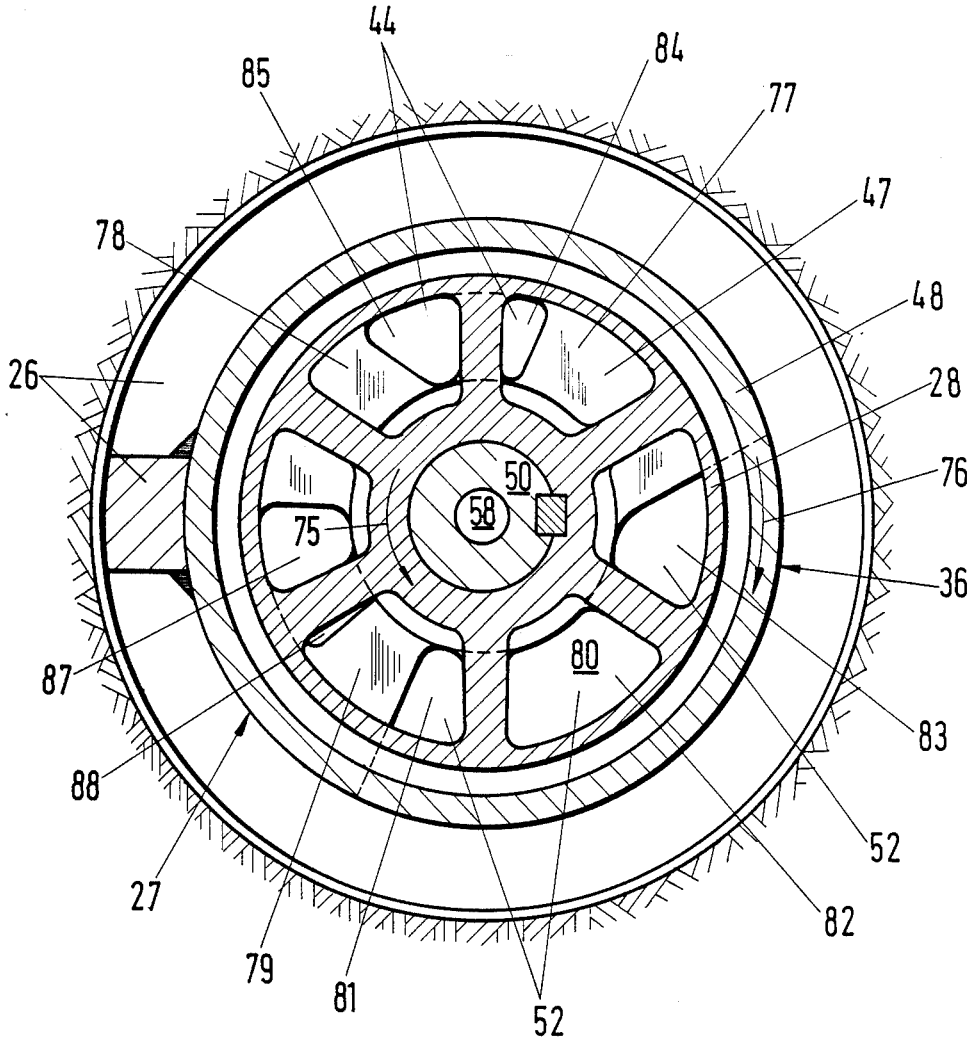
FIG. 3 is a sectional view taken along line III—III of FIG. 2.

With reference to FIGS. 2 and 3 it will be seen that at the center of the pilot drill 23 a bucket wheel sluice 27 is provided, which is connected to the rinsing conduit 16 and the ascending conduit 17. A bucket wheel 28 of the sluice 27 is driven by a first hollow shaft 29 which is concentrically surrounded by a second hollow shaft 30 and is supported in a plurality of bearings 31. The first hollow shaft 29 is rotated by the drive aggregate 12 which is formed as a motor via a drive pinion 32 and a drive gear 33. The second hollow shaft 30 is rotated by the drive aggregate 13 which is also a motor, via a pinion 34 and a gear 35. Thereby the first hollow shaft 29 and the second hollow shaft 30 can be driven in the same direction of rotation or the opposite directions of rotation. When shafts 29 and 30 are rotated in the same direction the speed of the first shaft 29 is considerably greater than that of the second hollow shaft 30.

A housing of the bucket wheel is designated by reference numeral 36. Advantageously the first hollow shaft 29 which drives gear 28 is rotated about the second shaft 30 which drives the bucket wheel housing 36 in the opposition direction.

Parallel to the axis of elongation 37 of the second hollow shaft 30, is arranged in this shaft at least one rinsing passage 38 which opens, at its lower end 39, into the bucket wheel sluice 27 and, at upper end 40, is connected via a rinsing head 41 with the rinsing conduit 16.

The first hollow shaft 29 has a central ascending passage 42 which is connected, at its lower end 43 with a discharge opening 44 (FIG. 2) of the bucket wheel sluice 27, and, at its upper end 45, is connected via a sealing head 46 with the ascending conduit 17. This ascending conduit 17 and the rinsing conduit 16 are non-rotationally supported on the shaft drilling machine 1 and can, due to their non-shown extensions, be lowered together with the machine into the shaft 6.

The bucket wheel housing 36 shown in FIGS. 2 and 3 is formed of three parts, namely a head portion 47, a sleeve-like jacket 48 of the pilot bore 23 and a bottom part 49, whereby the head portion and the bottom are rotation-fixed with the pilot drill 23, and the bucket wheel with the bucket wheel shaft 50 are rotated between the head portion 47 and the bottom part 49. The bucket wheel shaft 50 is rotation-fixed with the first hollow shaft 29.

The bucket wheel 28 is closed at its periphery 51 and is loadable through an inlet opening 52 provided in the head portion 47 of the bucket wheel housing 36. Bucket wheel 28 is emptied through a discharge or outlet opening 44 provided also in the head portion 47. The inlet opening 52 which merges into the spiral 26 is clearly shown in FIG. 1. A central ascending passage 42 of the first hollow shaft is connected with the outlet opening 44 of the bucket wheel sluice 27. A drilled material-fluid mixture 53 is conveyed through the central passage 42 into the ascending conduit 17 and from the latter to the non-shown mouth of the mine shaft from which the mixture is discharged outwardly.

Inasmuch as the jacket 55 and thereby the spiral 26 of the pilot drill 23 are rotated by the second hollow shaft 30 the drilled material will be conveyed from a borehole base 54 to the inlet opening 52 upwardly in the direction of arrow 56 as seen from FIG. 2. However the drilled material produced also by the enlarging bore tools 18 and 9*a* and moving in the direction of arrows 57 flows, due to its fluidity and gravity via the non-shown guide devices on the drill head to the inlet opening 52.

The bucket wheel 28 is driven by the bucket wheel shaft 50 which is in the driving connection with the first hollow shaft 29. The bucket wheel shaft 50 has a longitudinal bore 58 and a plurality of radial bores 59, 60 positioned above and below the bucket wheel 28 and branched off the longitudinal bore 58. Radial bores 59 which are located above bucket wheel 28 open into an annular passage 61 surrounded by the head portion 47 of the bucket wheel housing 36.

The rinsing passage 38 for rinsing fluid in turn opens into the annular passage 61. Radial bores 60 which are positioned below the bucket wheel 28 in the bucket wheel shaft 50 open into an enlarged passage 62 which ends in the bottom part 49 of the bucket wheel housing 36.

Bottom part 49 of housing 36 is axially displaceable on the bucket wheel shaft 50 against the force of at least one energy storage device 63 and is pressed against the bucket wheel 28. In the exemplified embodiment the energy storage device 63 is formed by a spring 63 positioned in the recess formed in the bottom part 49 of the bucket wheel housing 36. Spring 63 is supported at one end 64 thereof against the bottom part 49, and, at the other end 65 thereof, against an inner wall 66 of the pilot drill 23.

In order to minimize the play between the bucket wheel 28 and the bottom part 49 of the housing 36 the bottom part 49 is provided in its region of the greatest pressure loading with at least one cylinder-piston unit 68 which is parallel to the axis of rotation 67 of the bucket wheel shaft 50, and the piston end 69 of which is loaded with the drilled material-fluid mixture 53, and the cylinder of which is formed by a recess 71 of the bottom part 49 whereas the other piston end 70 of that unit is supported against the inner wall 66 of the pilot drill 23.

In the exemplified embodiment, the pilot drill 23 with its tools 24 is rotated counter to the bucket wheel 28 and with a different number of revolutions. This relative number of rovolutions or speed between the bucket wheel housing 36 and the bucket wheel 28, in addition to other influence factors, such as flow speed of the drilled material-fluid-mixture 54, properties of the fluid (water or air), physical properties of the material being drilled and dimensions of the inlet opening 52 and the bucket wheel 28, is different for volumes of the drilled material extracted per time unit. For efficiency, also, the sealing between the bucket wheel 28 and the head portion 47, and the bucket wheel and the bottom part 49 of the housing 36 should be determined. This sealing is provided in this embodiment by the aforedescribed minimizing of the play and also by sealing lips or rings 72 which can be replaced by any other suitable sealings. The upper annular space 61 is sealed by lip sealings 73. The enlargement 62 in the bottom part 49 is sealed by lip sealings 74. In this case, air can be utilized as the fluid. This is particularly advantageous if in case of an untight rock or for other reasons, the use of liquid as a fluid is not desired.

With reference to FIG. 3 the function of the bucket wheel sluice 27 will be now described. The bucket wheel 28 rotation-fixed, via the bucket wheel shaft 50, with the first hollow shaft 29 is rotated in the direction of arrow 75 whereas the bucket wheel housing 36 connected with the second hollow shaft 30 is rotated in the direction of arrow 76. Three overlapping regions 77, 78, 79 which belong to the head portion 47 of the bucket wheel housing 36 and shown as shaded portions in the background of the wheel 28 are seen in FIG. 3. These overlapping regions 77, 78 and 79 are of various size. The bucket wheel 28 is provided with six identically sized chambers 80. These chambers have substantially the shape of the circular segment. The filling of the non-shaded field 81 of the bucket wheel 28 starts in the rotation direction of arrow 75, follows at the field 82 and ends at the field 83. These three chamber regions or fields 81, 82, 83 can, during this movement phase, be filled with the drilled material flowing through the inlet opening 52 in the pilot drill 23 and thus into head portion 47 of the bucket wheel housing 36. Then these chambers are overlapped by the overlapping region 77 of the head portion 47 of the housing 36 and are sealed against the inlet opening 52. The fluid inlet opening 86 in bottom part 49 lies against the chamber regions 84, 85 so that the material being drilled will be mixed with the rinsing fluid in the bucket wheel 28. The fluid is led for this purpose through the rinsing passage 38 shown in FIG. 2, the annular space 61, radial bores 59, axial bore 58 and again via radial bores 60 into the enlarged passage 62. The drilled material-fluid mixture 53 will then be pressed from the chamber regions 84, 85 (FIG. 3) into the outlet opening 44, from which it will be guided through the lower ene 43 (FIG. 1) into the ascending passage 42 and from the latter, via the ascending conduit 17, towards the non-shown mouth of the mine shaft.

A relatively wider overlapping region 78 of the head portion 47 of the bucket wheel housing 36 is again closed at two outlet regions 84, 85 in FIG. 3. These outlet regions 84, 85 must be sealed relative to the unloading region which is closed and identified by small regions 87 and 88. In the aforedescribed movement stage, small regions 87 and 88 are in connection with the mine shaft 6 via the non-shown channel above the pilot drill 23 so that chambers 80 of the bucket wheel, which are under pressure in the outlet phase of operation, can unload or release this pressure so that the drilled material would not whirl up in the vicinity of the inlet opening 52 and thus the degree of admission of the bucket wheel sluice 27 would be reduced. The filling or inlet regions 81, 82, 83 again become connected to the unloading region 87, 88 of individual chambers 80 for a renew filling.

It is understandable that any modifications of the invention are possible. For example, the energy storage device 63 can be a pneumatically and/or hydraulically operated cylinderpiston unit in place of the spring.

Furthermore, lip sealings 72, 73, 74 can be replaced by any other suitable sealings.

The intermediate space between the hollow shafts 29 and 30 can be formed as a rinsing channel similarly to the rinsing passage 38. In such a case the rinsing channel would have a circular cross-section.

The rinsing passage 38 could be connected with the intermediate space between the jacket or periphery 51 of the bucket wheel 28 and the jacket 48 of the pilot drill 23 or with the longitudinal bores in the jacket 48 extending parallel to the axis of rotation. This intermediate space or these longitudinal bores would be then connected to the enlarged passage 62 of the bottom part of the bucket wheel housing 36. In such an embodiment, the sealings 73 and 74 of the shaft 50 and openable longitudinal bore 58 and radial bores 59, 60 may be omitted.

It will be understood that each of the elements described above, or two or more together, may also find a useful application in other types of drilling machines differing from the types described above.

While the invention has been illustrated and described as embodied in a drilling machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A shaft drilling machine, comprising a drill head carrying drill tools thereon; means for guiding said drill head in a shaft; means for advancing said drill head in the shaft; drive means which are lowered into the shaft together with said drill head and driving the latter; a sluice and rinsing means for providing a rinsing fluid; a rinsing conduit connected to said rinsing means to lead said fluid to said drill head in the vicinity of which said fluid is mixed with a drilled material; an ascending conduit to convey a generated drilled material fluid mixture to a shaft mouth; a pilot drill (23) connected to said drill head; said sluice being formed as a bucket wheel sluice (27) and positioned in said pilot drill, said bucket wheel sluice being connected to said rinsing conduit (16) and said ascending conduit (17).

2. The machine as defined in claim 1, wherein said bucket wheel sluice is positioned centrally of said pilot drill and has a bucket wheel (28), said drive means including a first hollow shaft (29) for driving said bucket wheel, a second hollow shaft (30) concentrically surrounding said first hollow shaft; said pilot drill further including a bucket wheel housing (36) driven by said second hollow shaft with a number of revolutions different from that of said bucket wheel (28).

3. The machine as defined in claim 2, wherein said first hollow shaft is rotated in a direction opposite to that of said second hollow shaft.

4. The machine as defined in claim 2, said second hollow shaft having an axis of elongation; said rinsing means including at least one rinsing passage (38) extending parallel to said axis of elongation, and a rinsing head (41), said rinsing passage having a lower end (39) which opens into said bucket wheel sluice and an upper end (40) which is connected through said rinsing head with said rinsing conduit (16).

5. The machine as defined in claim 4, wherein said first hollow shaft (29) has a central ascending passage (42), which has a lower end (43) connected to a discharge opening (44) of said bucket wheel sluice (27) and an upper end (45), said drill head having a sealing head (46), said upper end (45) of said ascending passage being connected to said ascending conduit (17) via said sealing head.

6. The machine as defined in claim 5, wherein said ascending conduit (17) and said rinsing conduit (16) are nonrotationally supported.

7. The machine as defined in claim 5, wherein said guide means (2) include a frame, said drive means further including a first drive motor (12) for driving said first hollow shaft, and a second drive motor (13) for driving said second hollow shaft, said first and second motor being positioned on said frame.

8. The machine as defined in claim 7, wherein said drive means further include a transmission means (32, 33; 34, 35) interconnected between respective motors and said first and second hollow shafts, respectively.

9. The machine as defined in claim 8, wherein said transmission means is a gear transmission means.

10. The machine as defined in claim 8, wherein said transmission means is a chain transmission.

11. The machine as defined in claim 7, wherein said bucket wheel housing (36) includes a head portion (47), a peripheral portion (48) which forms a jacket of said pilot drill, and a bottom part (49), said head portion and said bottom part being rotation-fixed to said pilot drill (23), said bucket wheel (28) being rotatable between said head portion and said bottom part (49).

12. The machine as defined in claim 11, wherein said pilot drill has front-side drill tools (24) and a spiral (26) provided on an outer periphery (25) of said pilot drill.

13. The machine as defined in claim 12, wherein said bucket wheel (28) is closed at a periphery (51) thereof, said head portion (47) of said housing (36) having an inlet opening (52), said bucket wheel being loadable with drilled material through said inlet opening and being emptied through said discharge opening (44) provided in said head portion (47).

14. The machine as defined in claim 12, wherein said drill tools on said drill head are positioned at least at a level of said inlet opening (52) of said head portion, said drill tools being at least active and inactive enlarging drill tools, said spiral starting approximately at said level of said inlet opening.

15. The machine as defined in claim 13, wherein said drive means further include a bucket wheel shaft (50) connected to said first hollow shaft for driving said bucket wheel (28), said bucket wheel shaft (50) having a longitudinal bore and a plurality of radial bores (59, 60) positioned above and below said bucket wheel, respectively and branched off said longitudinal bore, said head portion having an annular channel (61) which opens into said rinsing passage (38) for fluid, said radial bores (59) positioned above said bucket wheel being connected to said annular channel.

16. The machine as defined in claim 15, wherein said bottom part (49) has an enlarged channel (62) connected to said discharge opening, said radial bores (60) positioned below said bucket wheel opening into said enlarged channel (62).

17. The machine as defined in claim 16, further including at least one energy storage means, said bottom part (49) being axially displaceable on said bucket wheel shaft (50) against a force of said energy storage means and being pressable against said bucket wheel (28).

18. The machine as defined in claim 17, wherein said energy storage means includes a spring (63) positioned at said bottom part, said spring having one end (64) supported against said bottom part (49) and another end (65) supported against an inner wall (66) of said pilot drill.

19. The machine as defined in claim 18, wherein said bottom part (49) is provided in a region of the greatest pressure loading thereof with at least one cylinder-piston unit (68) with a piston having one piston end (69) which is loaded with the drilled material-fluid mixture (53) and a cylinder (71) formed by a recess provided in said bottom part, whereas another end (70) of said piston is supported against said inner wall (66) of said pilot drill.

20. The machine as defined in claim 19, wherein in a direction of rotation (75) of said bucket wheel (28), between said outlet opening (44) and said inlet opening (52), in at least said head portion (47) and said bottom part (49) of said bucket wheel housing (30), unloading regions (87,88) are provided, which are connected with an unloading passage which ends in a free space of the shaft (6).

21. The machine as defined in claim 17, wherein said first and second hollow shafts are spaced to form a hollow space therebetween, which constitutes a further rinsing passage.

22. The machine as defined in claim 16, wherein said rinsing passage (38) is connected at least with an intermediate space formed between a peripheral wall (51) of said bucket wheel (28) and a periphery (48) of said pilot drill, and longitudinal bores in said periphery (48) extending parallel to an axis of rotation (67) of said pilot drill, said at least intermediate space and longitudinal bores being connected to said enlarged channel (62) in said bottom part (49).

* * * * *